US005737771A

United States Patent [19]

Aanonsen

[11] Patent Number: 5,737,771

[45] Date of Patent: Apr. 14, 1998

[54] HEAT RESISTANT LIMB BRACE

[76] Inventor: Bobby Aanonsen, 465 Shore Rd., Apt. 6A, Long Beach, N.Y. 11561

[21] Appl. No.: 767,202

[22] Filed: Dec. 16, 1996

[51] Int. Cl.[6] ..... A41D 13/08

[52] U.S. Cl. ..... 2/16; 2/455

[58] Field of Search ..... 2/456, 458, 16, 2/22, 24, 161.1; 602/20, 21, 60, 62, 63

[56] References Cited

U.S. PATENT DOCUMENTS

| | | | |
|---|---|---|---|
| 3,374,487 | 3/1968 | Slimovitz | 2/161.1 |
| 4,856,112 | 8/1989 | Effle | 2/16 |
| 4,884,297 | 12/1989 | Triche | 2/16 |
| 4,951,317 | 8/1990 | Gray et al. | 2/16 |
| 4,959,875 | 10/1990 | Moon | 2/16 |
| 5,369,806 | 12/1994 | Chan | 2/161.6 |

*Primary Examiner*—C. D. Crowder
*Assistant Examiner*—Larry D. Worrell, Jr.
*Attorney, Agent, or Firm*—Martin S. Glass

[57] ABSTRACT

A heat resistant limb brace (10) comprising a flexible liner (12) to be worn about the skin (14) on a limb (16) of a person (18). An insulation jacket (20) is affixed to the flexible liner (12) to protect the skin (14) from heat, so that the skin (14) will not burn. A non-slip cover (22) is attached to the insulation jacket (20), to prevent items (24) placed against the non-slip cover (22) from sliding off.

18 Claims, 3 Drawing Sheets

Fig. 1
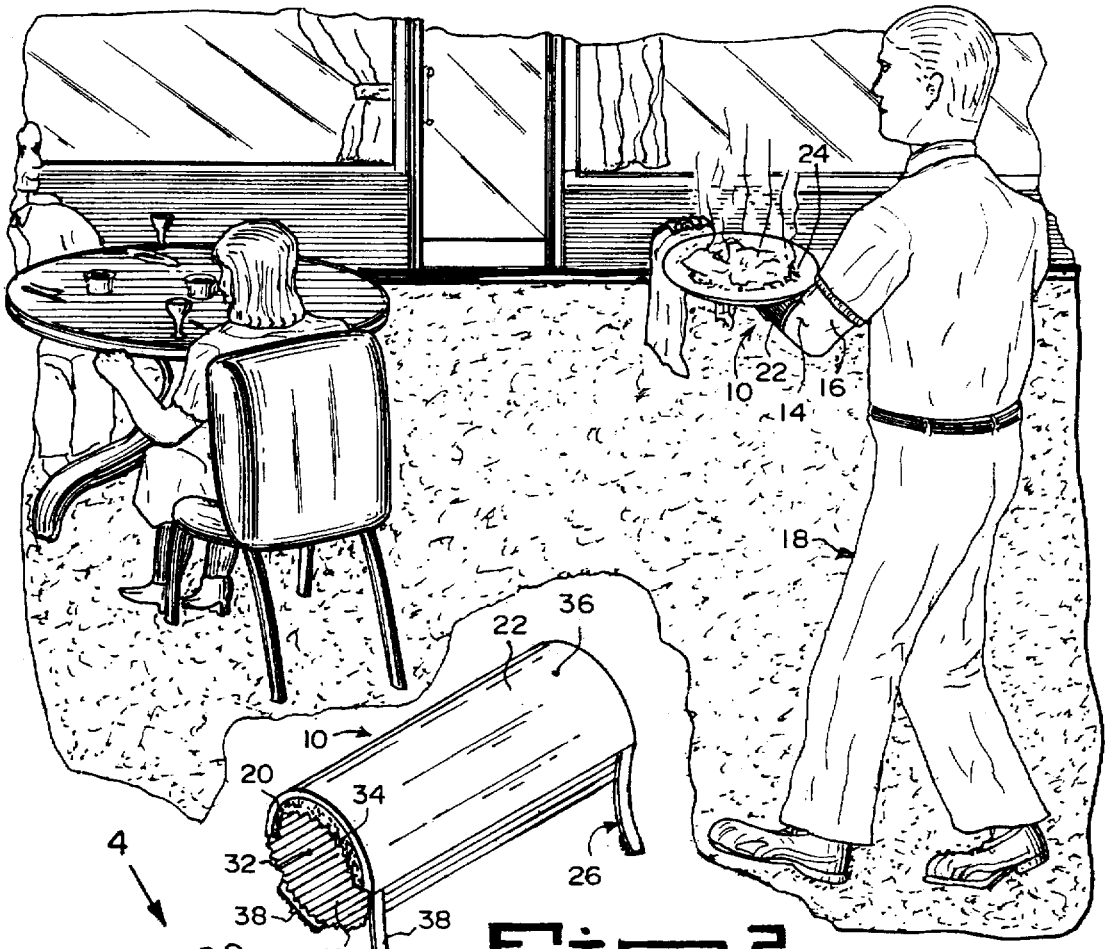
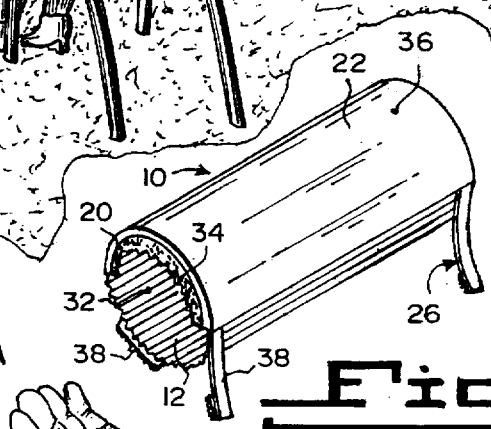
Fig. 2
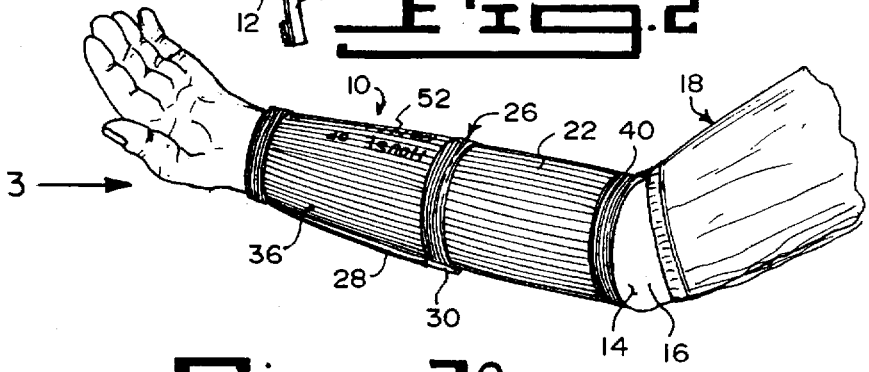
Fig. 2a

Fig. 3
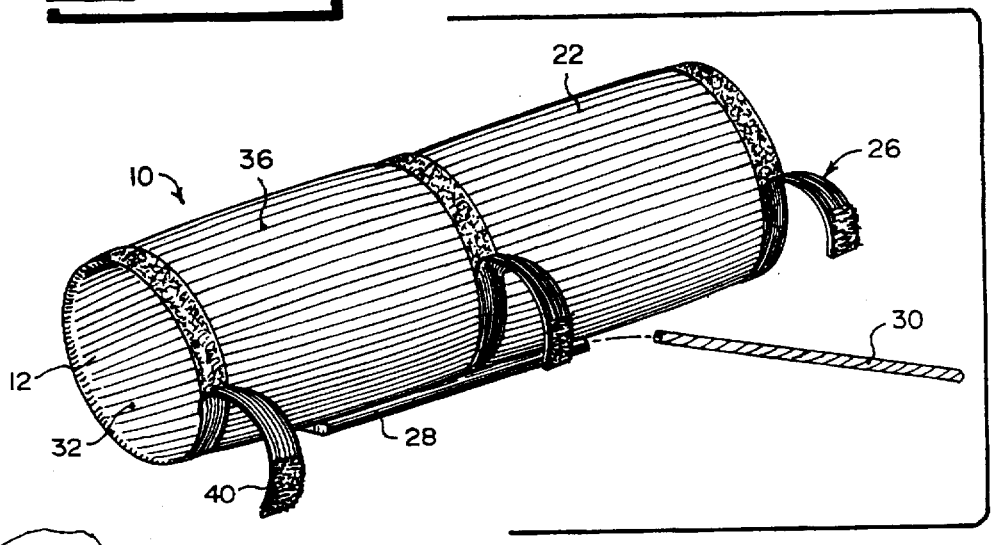
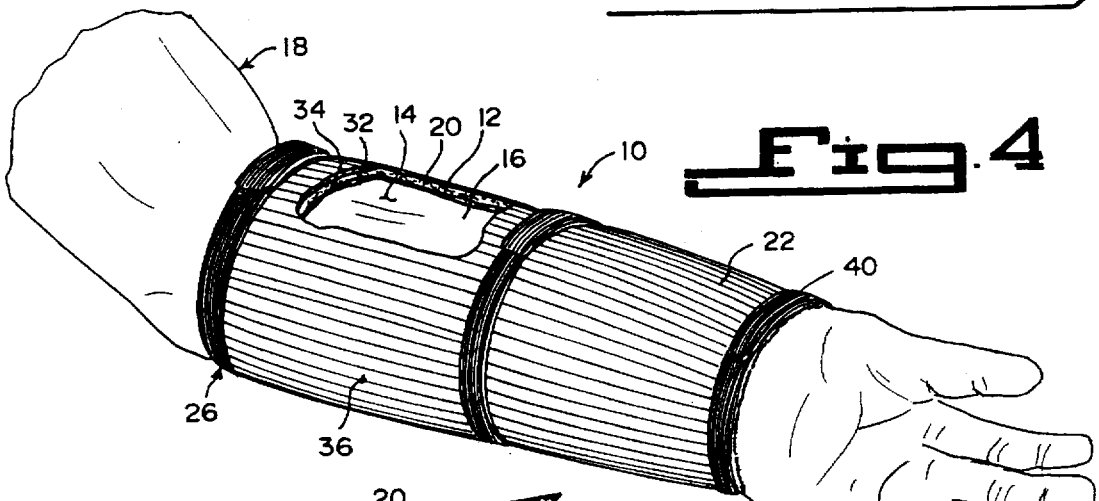
Fig. 4
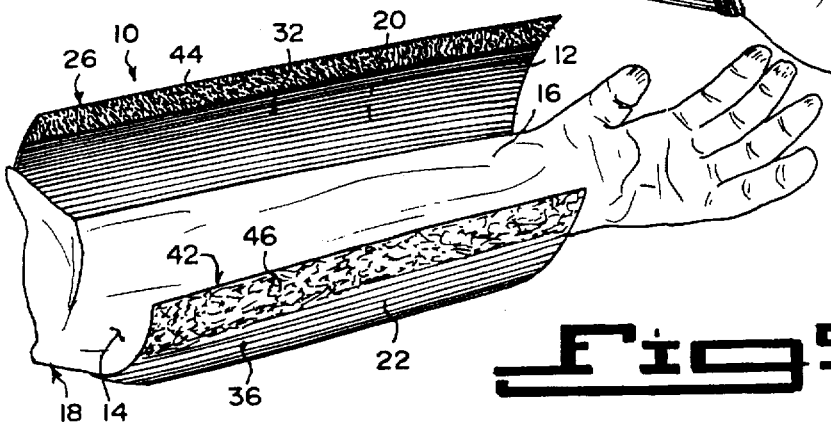
Fig. 5

HEAT RESISTANT LIMB BRACE

BACKGROUND OF THE INVENTION

1. Field of the Invention

The instant invention relates generally to protective garments and more specifically it relates to a heat resistant limb brace.

2. Description of the Prior Art

Numerous protective garments have been provided in prior art that are adapted to be worn on the person, so as to protect the body from harm. While these units may be suitable for the particular purpose to which they address, they would not be as suitable for the purposes of the present invention as heretofore described.

SUMMARY OF THE INVENTION

A primary object of the present invention is to provide a heat resistant limb brace that will overcome the shortcomings of the prior art devices.

Another object is to provide a heat resistant limb brace that can be worn on a forearm of a waiter or waitress, to that they can carry very hot dishes on the underside of the forearm without burning the skin.

An additional object is to provide a heat resistant limb brace that can be worn on a shank of a leg of a person, so that the leg will be protected when the person works, such as when doing arc welding.

A further object is to provide a heat resistant limb brace that is simple and easy to use.

A still further object is to provide a heat resistant limb brace that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view showing a waiter wearing a first embodiment of the instant invention on a forearm and carrying a hot dish in a restaurant.

FIG. 2 is a perspective view of the first embodiment per se.

FIG. 2*a* is a perspective view of a second embodiment of the instant invention worn on a forearm.

FIG. 3 is a perspective view of the second embodiment per se, taken in the direction of arrow 3 in FIG. 2*a*, showing the straw pouch attached thereto in greater detail.

FIG. 4 is a perspective view taken in the direction of arrow 4 in FIG. 2*a*, with parts broken away and in section.

FIG. 5 is a perspective view of a third embodiment of the instant invention ready to be installed on the forearm.

Figure 6:
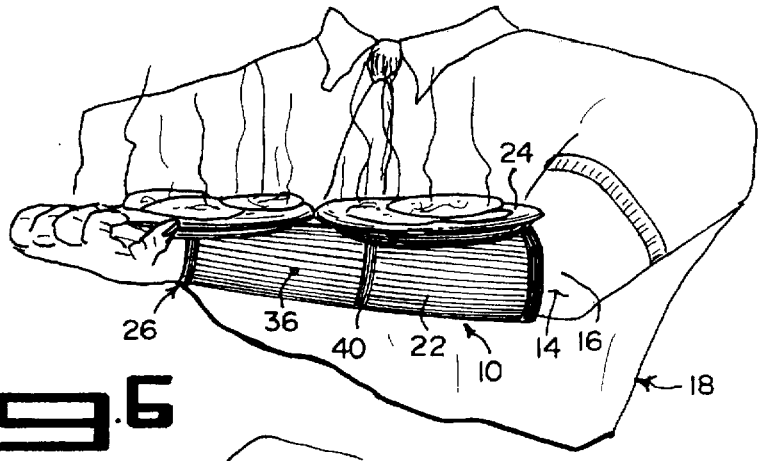

FIG. 6 is a perspective view of the second embodiment worn on a forearm of a waiter partly shown and carrying two hot dishes thereon.

Figure 6A:
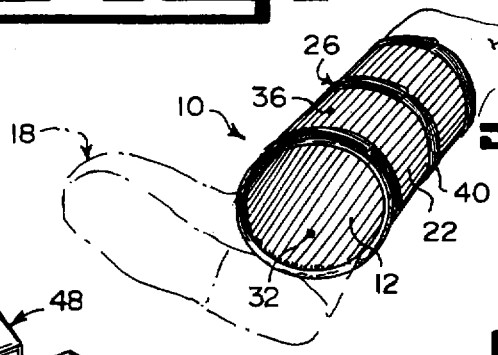

FIG. 6*a* is a perspective view of the second embodiment worn on a shank of a leg of a person, in which the leg is shown in phantom.

Figure 7:
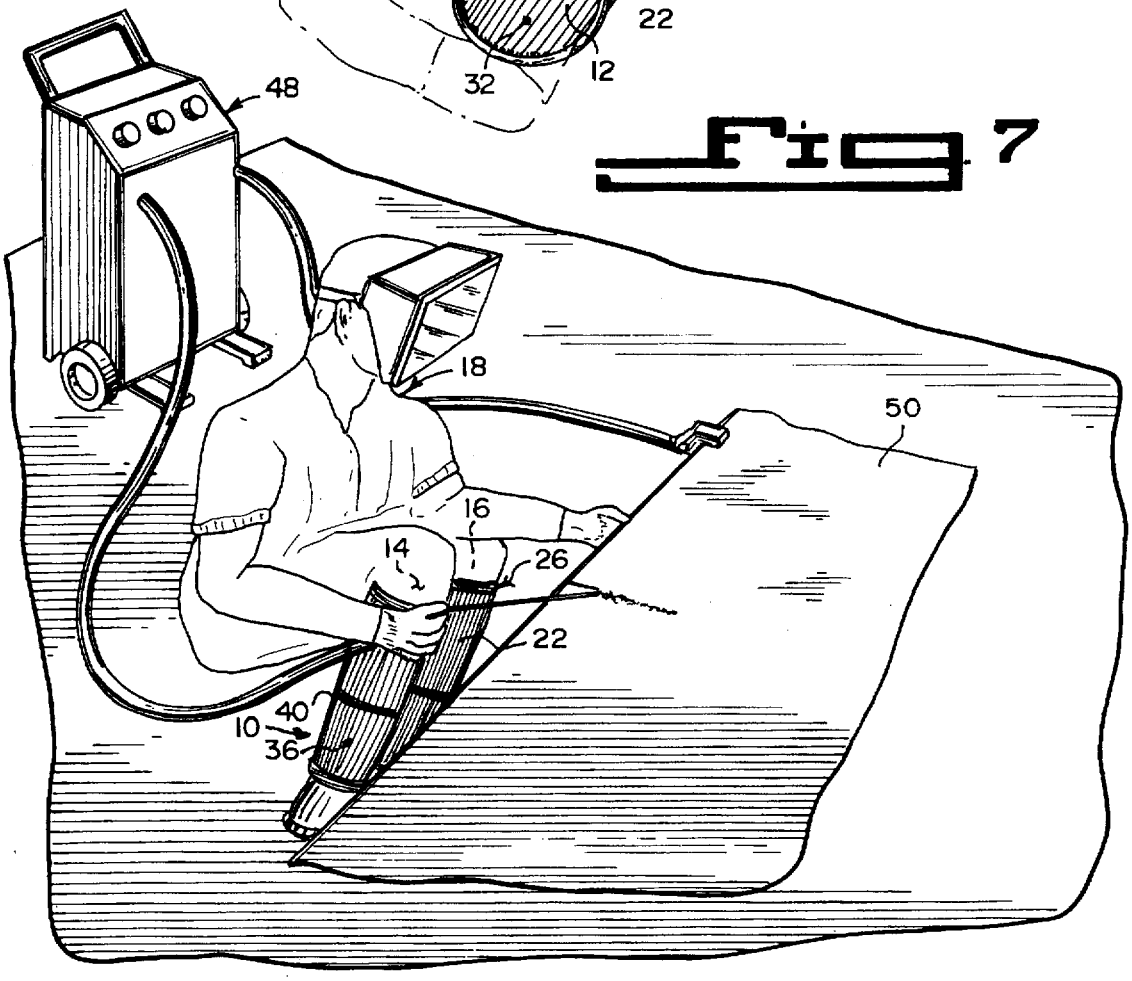

FIG. 7 is a perspective view of the second embodiment worn on and protecting two shanks of two legs of a person that is doing arc welding.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 7 illustrate a heat resistant limb brace 10 comprising a flexible liner 12 to be worn about the skin 14 on a limb 16 of a person 18. An insulation jacket 20 is affixed to the flexible liner 12, to protect the skin 14 from heat, so that the skin 14 will not burn. A non-slip cover 22 is attached to the insulation jacket 20, to prevent items 24 placed against the non-slip cover 22 from sliding off.

A facility 26 is for securing the flexible liner 12, the insulation jack 20 and the non-slip cover 22 over the limb 12 of the person 18, so that the heat resistant limb brace 10 will be held snugly in place. A pouch 28 can be longitudinally attached to the non-slip cover 22 to hold a plurality of drinking straws 30, so that the drinking straws 30 can be distributed from the pouch 28.

The flexible liner 12 is fabricated out of a cotton elastic fabric 32. The insulation jacket 20 is fabricated out of a heat absorbent material 34. The non-slip cover 22 is fabricated out of neoprene 36, which is a synthetic rubber produced by polymerization of chloroprene. The non-slip cover 22 can also be fabricated out of a heat resistant nylon produced by copolymerization of met-phenylenediamine isophthaloyl chloride.

As best seen in FIG. 2, the flexible liner 12 is tubular shaped, while the insulation jacket 20 and the non-slip cover 22 are each semi-tubular shaped. The securing facility 26 is at least one hook and loop type fastener 38, such as the trademark type fastener VELCRO fastener 38, which wraps about the flexible liner 12 and the non-slip cover 22.

As shown in FIGS. 2*a*, 3, 4, 6, 6*a* and 7, the flexible liner 12, the insulation jacket 20 and the non-slip cover 22 are each tubular shaped. The securing facility 26 is at least one hook and loop type fastener 40, such as the trademark type fastener VELCRO fastener 40 which wraps about the non-slip cover 22.

In FIG. 5, the flexible liner 12, the insulation jacket 20 and the non-slip cover 22 are each rectangular shaped. The securing facility 26 is a hook and loop type fastener 38, such as the trademark type fastener VELCRO fastener 42 being two elongated strips 44 and 46. The first elongated strip 44 is attached to the flexible liner 12 along a long edge. The second elongated strip 46 is attached to the non-slip cover 22 along a long edge opposite from the first elongated strip 44. When the heat resistant limb brace 10 is wrapped about the limb 16 of the person 18, the first elongated strip 44 will overlap and mate with the second elongated strip 46.

The limb 16 of the person 18 can be a forearm, as shown in FIGS. 1, 2*a*, 4, 5 and 6. This is ideal for use by a waiter or waitress. They can carry the items 24, which are hot plates, upon the underside of the forearm to prevent burns and scars upon the skin 14.

The limb 16 of the person 18 can be a shank of a leg, as shown in FIGS. 6*a* and 7. This is ideal for use by a welder using an arc welding machine 48 on a piece of sheet metal 50. The heat from the arc welding machine will not burn the skin 14.

The heat resistant limb brace 10 is made as a single unit and can also be fastened with snaps, zippers as well as VELCRO fasteners. The brace 10 can be colored to match and compliment the garment worn by the person 18. The brace 10 can also carry a logo 52 on the non-slip cover 22, as shown in FIG. 2*a*. The brace 10 is manufactured to be shear, comfortable, easy to pull on or off and must meet the conditions for which it is made for.

The length of the brace 10 can be approximately between eight and one half inches to eleven inches. The diameter at the wrist or ankle can be from five and one half inches to eight inches. The diameter at the elbow or knee can be from eight inches to eleven inches. The sizes are typical and not necessarily limited thereto.

LIST OF REFERENCE NUMBERS

10 heat resistant limb brace
12 flexible liner of 10
14 skin on 16
16 limb of 18
18 person
20 insulated jacket of 10
22 non-slip cover of 10
24 items
26 securing facility for 10
28 pouch on 22
30 drinking straw in 28
32 cotton elastic fabric for 12
34 heat absorbent material for 20
36 neoprene for 22
38 hook and loop type fastener
40 hook and loop type fastener
42 hook and loop type fastener
44 first elongated strip of 42 on 12
46 second elongated strip of 42 on 22
48 arc welding machine
50 piece of sheet metal
52 logo on 22

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A heat resistant limb brace comprising:

a) a flexible liner to be worn about a limb of a person;

b) an insulation jacket affixed to said flexible liner to protect said limb from heat; and c) a non-slip cover attached to said insulation jacket, to prevent items placed against said non-slip cover from sliding off, wherein said flexible liner is tubular shaped, while said insulation jacket and said non-slip cover are each semi-tubular shaped.

2. A heat resistant limb brace comprising:

a) a flexible liner to be worn about a limb of a person;

b) an insulation jacket affixed to said flexible liner to protect said limb from heat;

c) a non-slip cover attached to said insulation jacket, to prevent items placed against said non-slip cover from sliding off; and d) means for securing said flexible liner, said insulation jacket and said non-slip cover over said limb of a person, so that said heat resistant limb brace will be held snugly in place, wherein said flexible liner is tubular shaped, while said insulation jacket and said non-slip cover are each semi-tubular shaped.

3. A heat resistant limb brace as recited in claim 1, further including means for securing said flexible liner, said insulation jacket and said non-slip cover over the limb of the person, so that said heat resistant limb brace will be held snugly in place.

4. A heat resistant limb brace as recited in claim 1, further including a pouch longitudinally attached to said non-slip cover to hold a plurality of drinking straws, so that said drinking straws can be distributed from said pouch.

5. A heat resistant limb brace as recited in claim 1, wherein said flexible liner is fabricated out of a cotton elastic fabric.

6. A heat resistant limb brace as recited in claim 1, wherein said insulation jacket is fabricated out of a heat absorbent material.

7. A heat resistant limb brace as recited in claim 1, wherein said non-slip cover is fabricated out of neoprene which is a synthetic rubber produced by polymerization of chloroprene.

8. A heat resistant limb brace as recited in claim 1, wherein said non-slip cover is fabricated out of name for a heat resistant nylon produced by copolymerization of metphenylenediamine and isophthaloyl chloride.

9. A heat resistant limb brace as recited in claim 2, wherein said securing means is at least one hook and loop fastener, which wraps about said flexible liner and said non-slip cover.

10. A heat resistant limb brace as recited in claim 3, wherein said securing means is at least one hook and loop fastener which wraps about said non-slip cover.

11. A heat resistant limb brace as recited in claim 3, wherein said securing means is a hook and loop fastener being two elongated strips, in which said first elongated strip is attached to said flexible liner along a long edge, while said second elongated strip is attached to said non-slip cover along a long edge opposite from said first elongated strip, so that when said heat resistant limb brace is wrapped about the limb of the person, said first elongated strip will overlap and mate with said second elongated strip.

12. A heat resistant limb brace as recited in claim 2, further including a pouch longitudinally attached to said non-slip cover to hold a plurality of drinking straws, so that said drinking straws can be distributed from said pouch.

13. A heat resistant limb brace as recited in claim 12, wherein said flexible liner is fabricated out of a cotton elastic fabric.

14. A heat resistant limb brace as recited in claim 13, wherein said insulation jacket is fabricated out of a heat absorbent material.

15. A heat resistant limb brace as recited in claim 14, wherein said non-slip cover is fabricated out of neoprene which is a synthetic rubber produced by polymerization of chloroprene.

16. A heat resistant limb brace as recited in claim 14, wherein said non-slip cover is fabricated out of a heat resistant nylon produced by copolymerization of metphenylenediamine and isophthaloyl chloride.

17. A heat resistant limb brace as recited in claim 14, wherein said securing means is at least one hook and loop fastener, which wraps about said flexible liner and said non-slip cover.

18. A heat resistant limb brace as recited in claim 14, wherein said securing means is a hook and loop fastener being two elongated strips, in which said first elongated strip is attached to said flexible liner along a long edge, while said second elongated strip is attached to said non-slip cover along a long edge opposite from said first elongated strip, so that when said heat resistant limb brace is wrapped about the limb of the person, said first elongated strip will overlap and mate with said second elongated strip.

* * * * *